United States Patent [19]

Adams

[11] 4,023,794

[45] May 17, 1977

[54] OPTICAL ILLUSION DEVICE FOR CONCEALING AN OBJECT, ANIMAL OR THE LIKE TO BE PRODUCED

[75] Inventor: Joseph H. Adams, Brielle, N.J.

[73] Assignee: S.S. Adams Company, Neptune, N.J.

[22] Filed: Dec. 23, 1975

[21] Appl. No.: 643,630

[52] U.S. Cl. ..... 272/8 M; 272/13; 350/288

[51] Int. Cl.[2] ..... A63J 21/00

[58] Field of Search ..... 272/8 M, 8 N, 8 P, 8 R, 272/8 D, 8 F, 13, 8.5, 9, 10, 25, 26, 19, 20, 21, 27 R, 27 B, 27 N, 27 W, 1 R; 40/28 B, 219; 46/11; 273/153 R; 35/58; 312/224, 225, 226, 227; 240/4.1, 4.2; 350/288, 290, 291, 292

[56] References Cited

UNITED STATES PATENTS

| | | | |
|---|---|---|---|
| 609,009 | 8/1898 | Carrington | 272/8.5 |
| 1,680,855 | 8/1928 | Burns | 272/8 M UX |
| 1,721,014 | 7/1929 | Trippe-Fürst | 272/8 M |
| 1,740,842 | 12/1929 | Steen | 272/8.5 |

FOREIGN PATENTS OR APPLICATIONS

| | | | |
|---|---|---|---|
| 9,588 | 4/1914 | United Kingdom | 272/9 |
| 13,705 | 6/1913 | United Kingdom | 272/9 |
| 19,505 | 8/1910 | United Kingdom | 350/288 |

*Primary Examiner*—Richard C. Pinkham
*Assistant Examiner*—Arnold W. Kramer
*Attorney, Agent, or Firm*—Daniel H. Bobis

[57] ABSTRACT

A device for creating an optical illusion and for concealing an object, animal or the like to be produced defines, a space in which a reflective member is transversely disposed to divide the space into two compartments. In the device the optical illusion is effected in the first or lower compartment by a lined design on the inner walls of the compartment and the operative association of the coated peripheral edges of the reflective device which blend into and form part of the design to create the effect of double the space represented by the first or lower compartment. The second or upper compartment is concealed behind the reflective device and will hold the object, animal or the like to be produced. Access for viewing the first or lower compartment or for producing the object, animal or the like device from the second or upper compartment is accomplished by closure members which normally maintain the compartments closed and which are in alignment with each other so that when swung to open position away from each other the optical illusion can be enhanced.

4 Claims, 7 Drawing Figures

OPTICAL ILLUSION DEVICE FOR CONCEALING AN OBJECT, ANIMAL OR THE LIKE TO BE PRODUCED

BACKGROUND OF THE INVENTION

This invention relates generally to a magic trick and more particularly to a device which produces an optical illusion to provide a compartment in which an object to be produced can be concealed from the audience until it is desired to produce the object.

The use of a reflective device for creating an optical illusion in respect of space has been used in magical devices, and for decorating techniques and other procedures for the purpose of concealing hidden compartments.

The present invention provides an improved device for creating such an optical illusion so as to provide a compartment in which an object, animal or the like device can be concealed until it is desired to produce the same.

This is accomplished by providing a reflective device diagonally in a substantially cubed shaped box and so manipulating the box that only the first or lower half of the box will be viewed by an audience, while the second or upper half of the box is concealed therefrom. The first or lower compartment of the box is so designed on its walls that when operatively associated with the reflective device it gives the audience the effect of twice the space from the image reflected by the reflective device.

SUMMARY OF THE INVENTION

Thus the present invention covers an optical illusion device for concealing an object, animal or the like to be produced which includes, means for defining a space in which a reflective member is transversely disposed to divide the space into a first or lower compartment, and a second or upper compartment, a first closure means for the first or lower compartment and a second closure means for the second or upper compartment are disposed in alignment with each other, and said first or lower compartment has a design on the wall thereof, said reflective member has peripheral edge means respectively associated with the design on the wall of said first or lower compartment whereby when said first closure member is moved to open position the image reflected will appear to occupy the entire space defined by the device, and said second closure member movable from open to closed position and vice versa to permit access to the second or upper compartment for the placing therein of an object, animal or the like to be removed from said second or upper compartment.

Accordingly, it is an object of the present invention to provide an improved magic device for producing an object concealed therein.

It is another object of the present invention to provide an improved device for producing an optical illusion for the purpose of concealing a compartment therein.

It is another object of the present invention to provide a device for creating an optical illusion whereby a compartment is formed therein in which an object, animal or the like device can be concealed in said compartment.

With these and other objects and advantages the invention will become apparent from the following detailed description taken in conjunction with the accompanying drawings in which.

Figure 1:
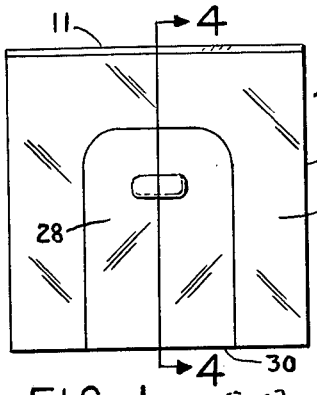
FIG. 1 is a front view of a device in accordance with the present invention.

Referring to the drawings FIGS. 1 to 7 of the drawings illustrate one preferred form of a device generally designated 1 in accordance with the present invention in which a substantially cubed shape box 10 has a top member 11, a bottom member 12, a front side 13, a back side 14, a left end side 15 and a right end side 16 which define a space in which a reflective member such as a mirror 17 is transversely mounted to divide the space into a first or lower compartment 18 and a second or upper compartment 19.

The reflective member 17 has its reflective surface 20 facing the first or lower compartment 18 and its peripheral edges as at 21, 22, 23 and 24 are disposed in engagement with the inner surfaces or walls of the box 10.

Thus the peripheral edge 21 will engage the corner where the top member 11 and front side 13 meet. The peripheral edge 23 will engage the corner where the bottom 12 and the back side 14 meet, the peripheral edge 22 will engage the inner surface or wall of the right end side 15 and the peripheral edge 24 will engage the inner surface or wall of the left end side 16.

The importance of the relation of the peripheral edges 21, 22, 23, and 24 to the inner surface or walls of the top, bottom front, side, back side, right end side and left end side of the box 10 will become apparent in respect of the optical illusion to be created by the device 1 in accordance with the invention as is hereinafter more fully described.

Figure 7:
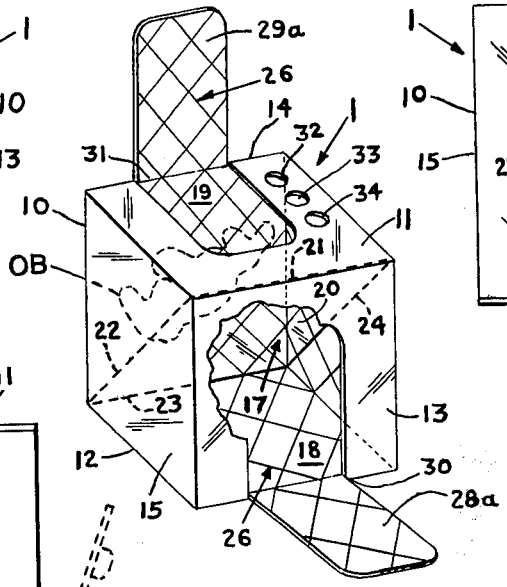
FIG. 7 is a perspective view of the device shown in FIGS. 1 to 5 of the drawings.
Figure 3:
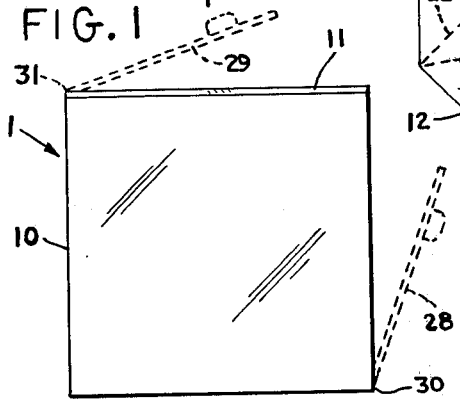
FIG. 3 is a side view of the device shown in FIG. 1 with the closure members shown in partially open position in dotted form.
Figure 4:
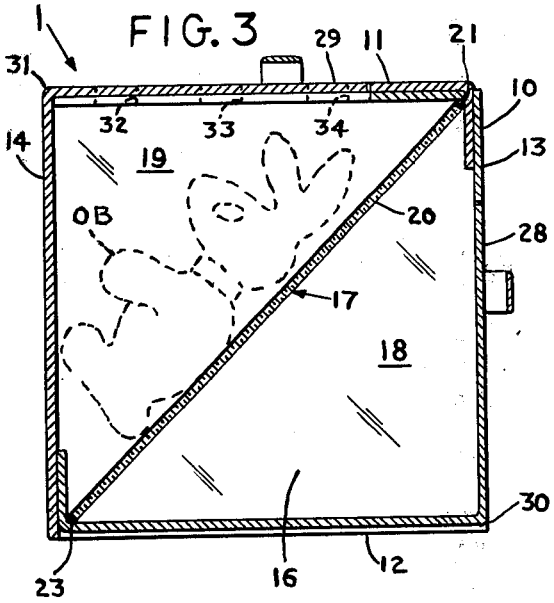
FIG. 4 is a vertical section taken on line 4—4 of FIG. 1.
Figure 6:
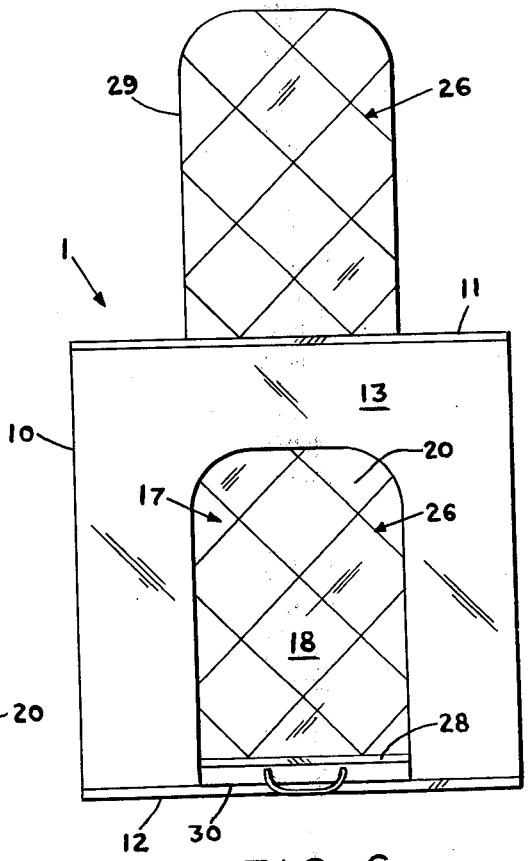
FIG. 6 is a front view taken of the device shown in FIGS. 1 to 4 with the lower closure member open so that the image of the lined design on the inner wall of the lower compartment as reflected by the reflective member.

Thus if reference is had to FIGS. 4, 6 and 7 of the drawings it will be seen that the inner walls of the front side 13, the bottom 12 and the portions of the respective right end side 15 and left end side 16 which define the first or lower compartment 18 have a lined design generally designated 26 thereon which includes at least two or more intersecting lines.

These lines and the spaces therebetween preferably have a distinctive combination of colors and it will be noted that at least the peripheral edges 21, 22 and 23 of the reflective member will be disposed so that they are parallel to and spaced from the nearest line on the given design which may be placed on the walls which define the first or lower compartment 18.

This construction is desired for the present invention because the peripheral edges 21, 22 and 23 of the reflective device will be coated to match the color of the lines in said design 26. Therefore when the design 26 is viewed as is hereinafter more fully described, the peripheral edges 21, 22 and 23 appear to be part of the design which is reflected by the reflective surface of the reflective member 20.

In order to gain access to the first or lower compartment 18 to place the design in a position to be viewed or to permit access to the second or upper compartment 19 to place an object, animal or the like member therein generally designated OB or to remove the same therefrom, a first closure member as at 28 is provided for the first or lower compartment 18, and a second closure member 29 is provided for the second or upper compartment 19.

Figure 2:
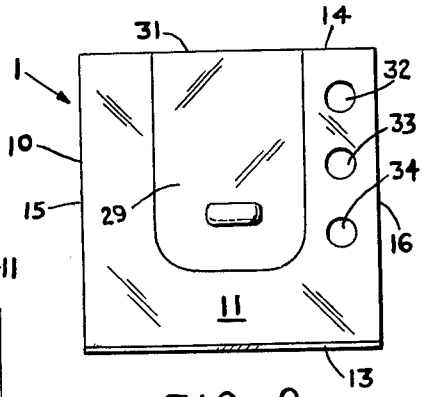
FIG. 2 is a top view of the device shown in FIG. 1.
Figure 5:
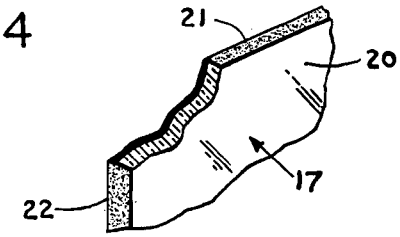
FIG. 5 is a fragmentary view of the reflective member illustrating the coating on the peripheral edges thereof.

FIGS. 2, 4, and 5 show that the first closure member 28 is pivotly connected or hinged as at 30 to the front side or 13 of the Box 10 and that the second closure member 29 is pivotly connected or hinged as at 31 to the top member 11 of the Box 10.

These members are so constructed that they are in alignment with each other and on their inner face bear the same line design as at 28*a* and 29 *a* as is provided on the inner walls of the lower compartment 18. Further as shown in the drawings they will when moved to open position, pivot so that they swing away from each other, and thus in effect become the respective mirror images for each other, the significance of which will be clear when the operation of this optical illusion production device is described below.

The second or upper compartment 19 will be formed on the back or concealed side of the reflective member and is defined by the inner walls of the top member 11, the backside 14, and the respective inside portions of the inner surface or wall of the right end side 15 and the left end side 16.

Compartment 19 receives the object, animal or like device OB that is to be produced by the device 1 in accordance with the present invention, and if the device is an animal, it is necessary that air holes as at 32, 33 and 34 be provided so that the animal has an adequate air supply to prevent suffocation thereof during the use of the device 1.

OPERATION

In operation it is necessary as in all magic tricks to prepare the device before creating the optical illusion.

Accordingly, the second closure member 29 on the box 10 is first opened and the animal, object or other things such as hankerchiefs, scarfs, etc. are inserted or placed in the second or upper compartment 19 so they will be in a position to be produced during the course of the use of the device 1.

After this preparation, the device 1 is now ready to be presented to the audience as a magic trick.

Accordingly at the time of the presentation the box is lifted and presented to the audience with the front side 13 showing. Then both the first closure member 28 and second closure member 29 are open to an angle of 90° with the associated side of the box 10 to which the respective closure members are pivotally connected.

The first closure member is held with the thumb and first two fingers of the right hand curled around the door.

The second or upper closure member for the upper compartment is held by the left hand in an identical manner.

The audience is permitted to look through the first or lower closure member into the first or lower compartment and the optical illusion that they will see is an empty box. This illusion can be heightened if you wiggle the fingers of each of the respective hands because by wiggling the fingers of the respective hands you appear to be moving the hand which is holding the second or upper closure member.

After the audience sees what appears to be the empty box 10 the first closure member and the second closure member are both closed and typical magic words are said over the box as both hands are waved across the box or a magic wand is waves across the box with the necessary wording such as "abbracadabra."

Then the second or upper closure member is opened and the object or animal, which had been previously inserted, removed from the empty box.

It is thought obvious that the reverse process can also be repeated, namely the disappearance of the object or animal by reversing the procedures above set forth.

It is important that the audience does not have an opportunity to view the upper or top member of the box 10 when the second or upper closure member is opened as the magic trick will then become obvious to them and the illusion will not be effective.

It will be understood that the invention is not to be limited to the specific construction or arrangement of parts shown but that they may be widely modified within the invention defined by the claims.

What is claimed is:

1. An optical illusion device for providing a compartment to conceal an object, animal and the like to be produced including;

a. box like means having a top, a bottom, and side means connected to the top and bottom, b. said top, bottom, and side means respectively each having an inner wall means and defining therebetween a space, c. a reflective means having a reflective surface, and peripheral edges mounted in the box like means transversely of the medial section of said space to divide said space into a first compartment on the side of said reflective means having the reflective surface and a second compartment on the side of the reflective means remote from the reflective surface, d. a part of the side means and a part of the bottom associated with the reflective surface of the reflective means to define therewith the first compartment, e. a part of the top and a part of the side means are associated with the remote side of the reflective means to define therewith the second compartment, f. a first closure means in said side means pivotally connected adjacent said bottom and normally disposed to maintain said first compartment closed, said first closure means movable from closed to open position to permit said first compartment to be viewed.

g. a second closure means spaced from said first closure means in the top pivotally connected adjacent said side means and normally disposed to maintain said second compartment closed, said second closure means movable from closed to open position to permit access to said second compartment, h. said first closure means and said second closure means sized and shaped substantially identical to each other and movable to open position respectively in opposite directions from each other along a vertical plane which traverses the medial sections of the first compartment, the reflective means and the second compartment, i. said inner wall means of the bottom, and side means defining the first compartment having a lined design thereon, and j. the peripheral edges of said reflective means in engagement with the side means and the bottom of said first compartment and disposed for operative association with said lined design on the inner wall means to form part thereof reflected by the reflective surface of said reflective means when said first closure means is moved to open position.

2. In an optical illusion device as claimed in claim 1 wherein;

a. said peripheral edges of said reflective means are coated to color said peripheral edges, and b. said peripheral edges having the same color as the color of the lines in the lined design on the inner wall means of the bottom and side means defining the first compartment.

3. In an optical illusion device as claimed in claim 1 wherein;

a. the line design on the inner wall means of the bottom and side means defining the first compartment has at least one pair of intersecting lines, b. the peripheral edges of the reflective means are coated to color the same, and c. said peripheral edges colored the same color as the intersecting lines of the lined design and disposed in spaced relation thereto.

4. An optical illusion device for providing a compartment to conceal an object, animal and the like to be produced includes;

a. box like means having a top, a bottom and side means connected to the top and bottom, said top, bottom and side means each having inner wall means and defining therebetween a space, b. reflective means in said box like means disposed transversely thereof to divide the space into a first compartment and a second compartment, c. said first compartment in communication with said reflective means and said second compartment disposed on the side of the reflective means remote therefrom.

d. a first access means pivotally connected in the top of said box like means normally disposed to maintain said second compartment closed and movable from closed to open position to permit said second compartment to be viewed, e. a second access means having the same shape as said first access means and pivotally connected in the side means of said box like means a spaced distance from said first access means and symmetrically disposed for movement in the same plane of movement as the first access means, f. said second access means disposed to normally maintain said first compartment closed and movable from closed to open position to permit access to said first compartment, g. said first access means and said second access means movable to open positions respectively in directions opposite from each other and constituting mirror images of each other in the open position.

h. a part of the side means and a part of the bottom associated with the reflective surface of said reflective means to define therewith said first compartment, i. the inner wall means of the bottom, and side means of said first compartment having a lined design thereon, and at least one set of intersecting lines on said lined design, j. said reflective means having peripheral edges thereon disposed in engagement with said inner wall means in the first compartment, k. said peripheral edges of the reflective means having the same color as said intersecting lines of the lined design, and l. said peripheral edges disposed in spaced relation to the intersecting lines whereby on movement to open position said reflective surface will reflect the lined design in said first compartment and give an optical effect of a compartment the size of the entire box like means.

* * * * *